United States Patent [19]

Focke et al.

[11] Patent Number: 4,789,060

[45] Date of Patent: Dec. 6, 1988

[54] CUBOID PACK FOR CIGARETTES WITH TRANSVERSE CUT LINES

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 163,165

[22] Filed: Feb. 25, 1988

Related U.S. Application Data

[63] Continuation of Ser. No. 896,047, Aug. 13, 1986, abandoned.

[30] Foreign Application Priority Data

Aug. 14, 1985 [DE] Fed. Rep. of Germany ..... 3529119

[51] Int. Cl.[4] ..... B65D 85/10

[52] U.S. Cl. ..... 206/274; 206/264; 206/624; 229/87 C

[58] Field of Search ..... 206/271, 273, 274, 275, 206/264, 624, 628, 631, 634, 621, 620; 229/87 C, 44 CB

[56] References Cited

U.S. PATENT DOCUMENTS

| | | | |
|---|---|---|---|
| 1,291,984 | 1/1919 | Maloney | 206/273 X |
| 1,355,658 | 10/1920 | Dula | 206/274 X |
| 1,456,060 | 5/1923 | Johnstone | 206/273 X |
| 2,984,384 | 5/1961 | Chalmers et al. | 229/87 C |
| 3,963,173 | 6/1976 | Stone | 229/44 CB |
| 4,154,390 | 5/1979 | Focke et al. | 229/87 C |
| 4,293,068 | 10/1981 | Focke et al. | 206/264 |
| 4,300,676 | 11/1981 | Focke et al. | 206/264 |
| 4,303,155 | 12/1981 | Focke et al. | 206/264 |
| 4,375,260 | 3/1983 | Focke et al. | 206/264 |
| 4,607,748 | 8/1986 | Focke et al. | 206/273 X |

FOREIGN PATENT DOCUMENTS

| | | |
|---|---|---|
| 1626136 | 5/1954 | Fed. Rep. of Germany . |
| 2420110 | 11/1974 | Fed. Rep. of Germany . |
| 450274 | 4/1968 | Switzerland . |

*Primary Examiner*—Stephen Marcus
*Assistant Examiner*—Bryon Gehman
*Attorney, Agent, or Firm*—Sughrue, Mion, Zinn, Macpeak and Seas

[57] ABSTRACT

Inner wrappings (20) for cigarette groups (21) or the like, as part of the pack, should be as effectively sealed against aroma and moisture losses as possible. For this purpose, side tabs (34, 35) for forming side walls (27, 28) are connected to one another in a sealed manner in the region of overlapping strips (37, 38), to form a bonding strip (36). The bonding strip (36) extends over part of the height or length of the inner wrapping (20), so that an opening flap (29) can be freed from the inner wrapping (20).

2 Claims, 8 Drawing Sheets

Fig. 1
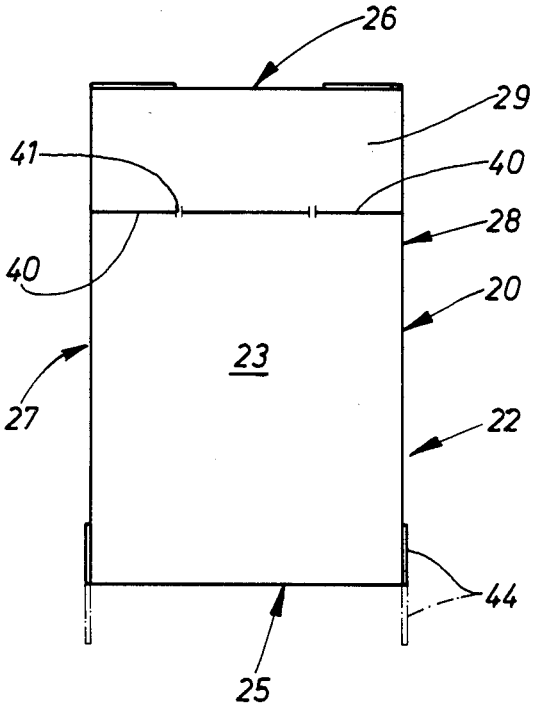
Fig. 2
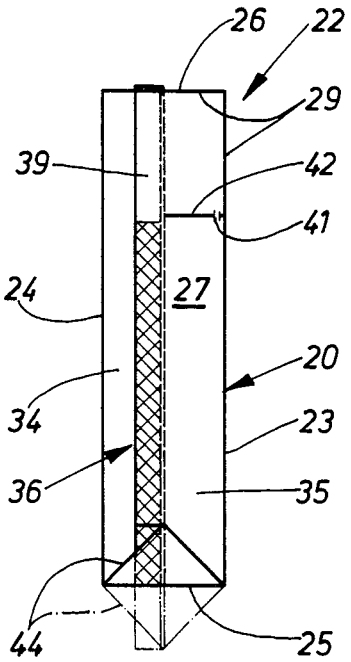
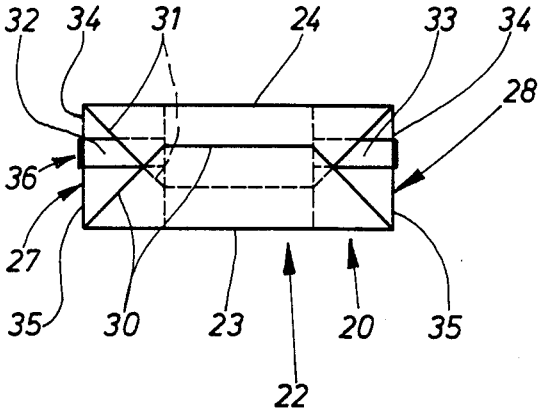
Fig. 3

Fig. 4
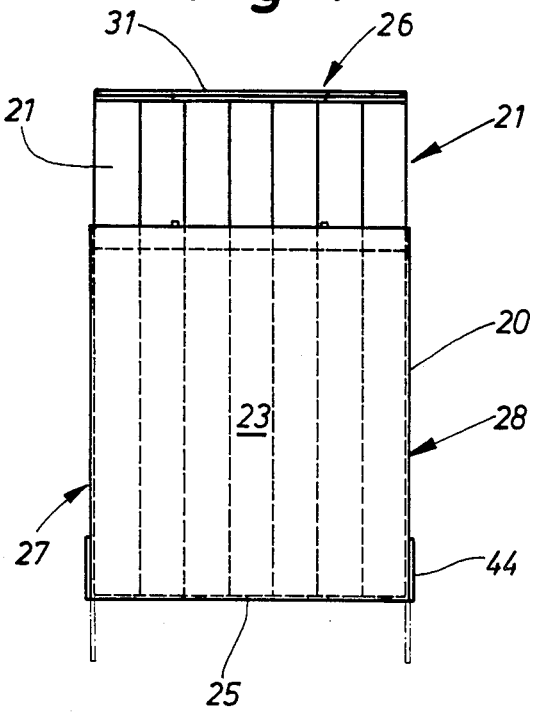
Fig. 5
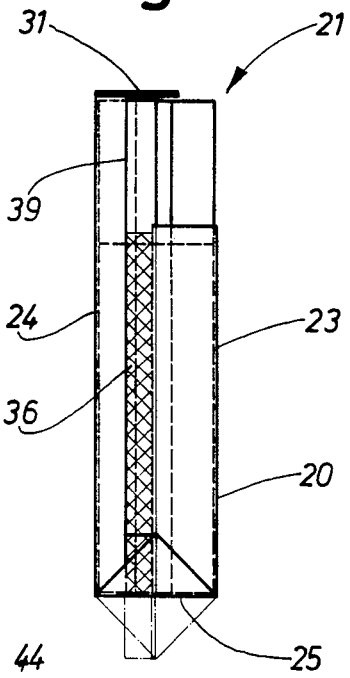
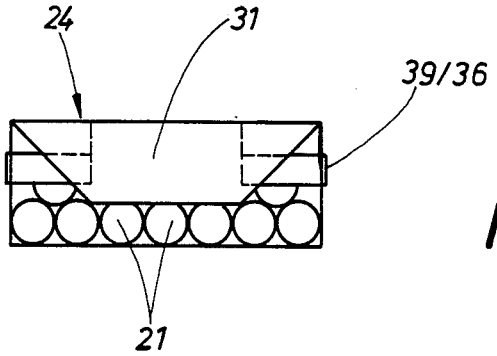
Fig. 6

CUBOID PACK FOR CIGARETTES WITH TRANSVERSE CUT LINES

This is a continuation of application Ser. No. 06/896,047 filed Aug. 13, 1986 now abandoned.

BACKGROUND OF THE INVENTION

The invention relates to a cuboid pack for cigarettes or the like, with an inner wrapping, especially a tin-foil blank, surrounding a cigarette group and with an outer wrapping made of paper or (thin) cardboard, the inner wrapping having, at least in the region of narrow side walls and an upper end wall, folding tabs (inner and outer side tabs and end tabs) with partial overlapping and, in the region of a front wall, a pull-off opening flap on the end face. The invention also relates to a process for producing a pack or inner wrapping of this type.

The cigarette packs to be found on the market are predominantly formed by wrapping a cigarette group in an inner blank (tin-foil blank) which, in the region of side walls, has side tabs partially overlapping one another and the upper end wall of which likewise consists of end tabs folded in the manner of an envelope with partial overlapping. The front wall of this inner wrapping is provided with a pull-off opening flap. This is sometimes designed as a separate blank (consisting of tin-foil) which, as part of the inner wrapping, is folded together with the latter. Often, however, the opening flap is part of the inner wrapping itself and is divided off from this by means of punchings with residual connections. Such inner wrappings or tin-foil blocks are encountered in packs of the hinge-lid and soft-cup type.

The inner wrappings made of tin foil or the like which are designed in the way described above can be produced economically. One disadvantage, however, is that the content (cigarettes) is inadequately safeguarded against drying out and losses of aroma.

SUMMARY OF THE INVENTION

The object on which the invention is based is to provide an inner wrapping for cigarette groups or the like, which can be produced economically, but which nevertheless ensures a distinctly improved isolation of the pack content against aroma and moisture losses.

To achieve this object, the pack according to the invention or its inner wrapping is characterized in that the side tabs, with the exception of a portion adjacent to the opening flap, are connected to one another by means of adhesive bonding, welding or the like along an overlapping strip.

The conventional material for the inner wrapping, especially tin foil, is relatively aroma-tight and moisturetight when it leaves the factory. The invention now starts from the knowledge that an inner wrapping hermetically sealed in the region of the side walls and, if appropriate, of the upper end wall, because the folding tabs are suitably joined to one another, presents considerable problems when the inner wrapping is opened in order to make use of the pack. For this reason, according to the invention, the side tabs partially overlapping one another are joined to one another in a sealed manner, especially by means of continuous strip-shaped bonding, only outside the region of the opening flap. Adjacent to the opening flap, in particular over the full height of the latter, the side tabs and also the end tabs are not connected to one another. As a result, the opening flap can be pulled off in the usual way without trouble, to form the extraction orifice for the cigarettes. On the other hand, the predominant region of the inner wrapping is sealed off at the side walls, so that, altogether, the aroma and moisture losses occurring during storage are reduced considerably.

According to a further feature of the invention, the side tabs are brought into the position of a fin-type fold, at least in the region where they are bonded to one another, so that the overlapping strips rest with their inner faces against one another and are connected to one another to form a bonding strip.

The opening flap can be of conventional design. Alternatively, the opening flap is limited, in the region of the side walls, by a lateral severing cut which extends obliquely upwards to the end wall. An extension of the bonding strip in the region of the side walls and a further improvement in aroma and moisture preservation are achieved thereby.

In the process according to the invention for producing an inner wrapping of this type, the overlapping strips of the side tabs are first folded into a position in which the inner faces are turned outwards. A connecting means (glue) must now be coated onto the side tabs or overlapping strips by tools of simple design, for example by glueing rollers which are arranged laterally next to a feed track for the tin-foil blocks and which rotate about vertical axes. The overlapping strips are then pressed against one another into a position transverse relative to the plane of the side walls. The overlapping strips now connected to one another are subsequently folded round against the side walls.

The inner wrapping formed in this way can be produced economically on current packaging machines by means of the process described above.

BRIEF DESCRIPTION OF THE DRAWINGS

Exemplary embodiments of the cigarette packs according to the invention are explained in detail below with reference to the drawings. In these:

FIG. 1 shows a front view of an inner wrapping of a cigarette group (cigarette block), FIG. 2 shows a side view of FIG. 1, FIG. 3 shows a plan view or end view of FIG. 1, FIG. 4 shows a front view of the cigarette block according to FIG. 1, with the opening flap pulled off, FIG. 5 shows a side view of FIG. 4, FIG. 6 shows a plan view or end view of FIG. 4.

DETAILED DESCRIPTION OF PREFERRED EMBODIMENTS

Figure 7:
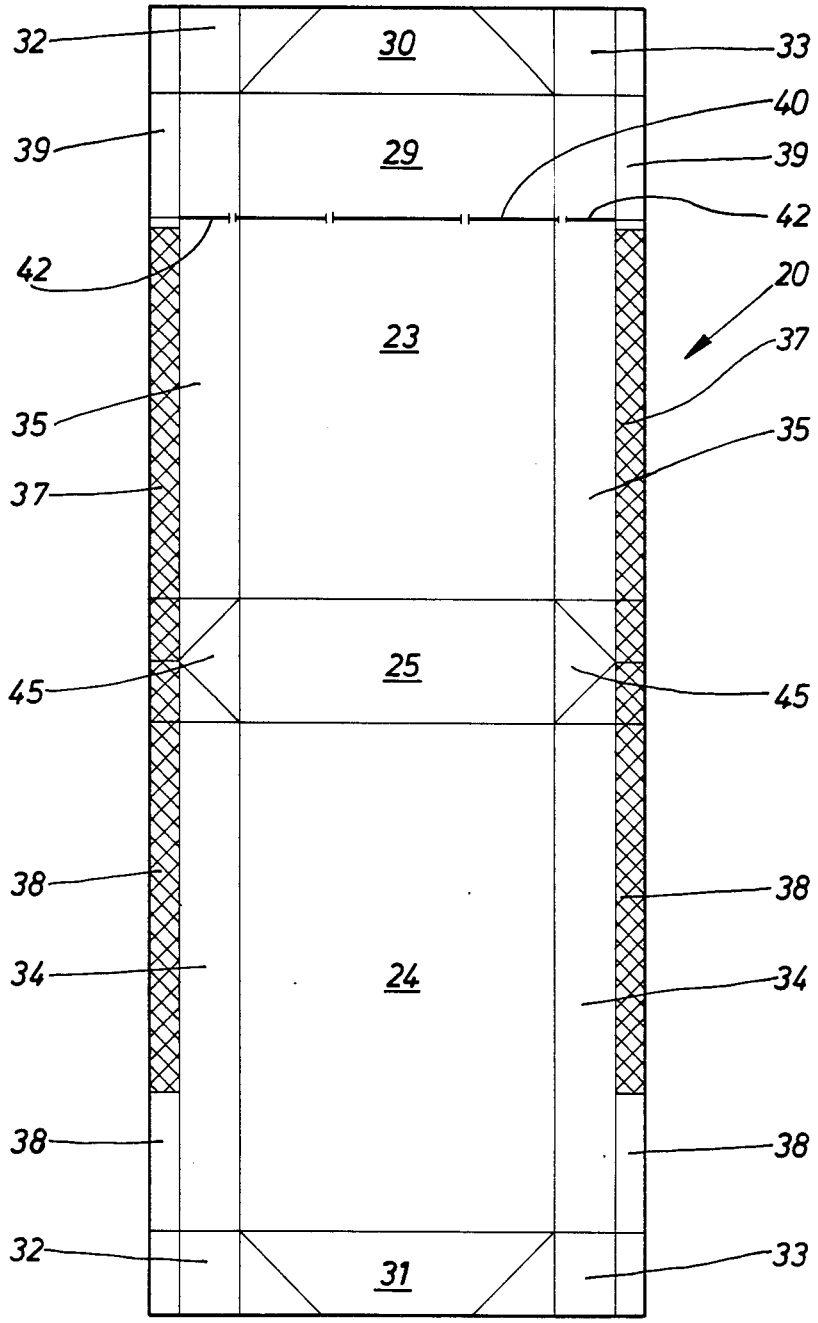
FIG. 7 shows a spread-out blank for an inner wrapping according to FIGS. 1 to 6.

The exemplary embodiments illustrated refer to cigarette packs. In each case, only an inner wrapping 20 for a cigarette group 21 is shown. The cuboid structure cigarette block or tin-foil block 22 - is accommodated in an appropriate outer wrapping, especially a hinge-lid pack or a soft-cup pack. The inner wrapping preferably consists of tin foil.

The cigarette group 21 is wrapped in the inner wrapping 20, in such a way that a front wall 23, a rear wall 24, a bottom wall 25, an end wall 26 and elongate side walls 27 and 28 are obtained. The blank of the inner wrapping 20 is folded so that the front wall 23, rear wall 24 and bottom wall 25 are formed so as to be continuously closed, with the exception of an opening flap 29, yet to be described, located in the region of the front wall 23. The end wall 26 is formed by folding tabs folded in the manner of an envelope, in particular trapezoidal longitudinal end tabs 30 and 31. These are connected to the front wall 23 and rear wall 24 respectively. The end wall 26 is also composed of lateral end tabs 32 and 33 which respectively adjoin the side walls 27 and 28.

These two are also formed from folding tabs partially overlapping one another, in particular side tabs 34 and 35.

The dimensions of the side tabs 34 and 35 which extend over the full length of the side walls 27 and 28 are such that they overlap one another in the region of a bonding strip 36 by means of overlapping strips 37, 38 arranged at the edge of each side tab 34, 35. These overlapping strips 37, 38 are connected to one another firmly and in a sealed manner in a part region of the side walls 27, 28, in particular by means of adhesive bonding, welding or the like.

The overlapping strips 37, 38 also extend in the region of the lateral end tabs 32, 33, since these originally, in particular before being folded round, form extensions of the blank parts for the side walls 27, 28. The firm connection or bond of the overlapping strips 37, 38 only extends over a part region facing the bottom wall 25. An upper portion 39, facing the end wall 26, of the covering strips 37, 38 remains free of adhesive bonding. Here, the overlapping strips 37, 38 rest against one another without being connected.

The length of this portion 39 in the region of the side walls 27, 28 corresponds approximately to the constructive height or length of the opening flap 29. In the exemplary embodiments illustrated, this is formed from the blank of the inner wrapping 20, in particular being delimited by a transverse punching 40 (severing cut) in the region of the front wall 23 with residual connections 41 and by connecting cuts 42 in the region of the side walls 27, 28. The connecting cuts 42 only extend in the region of the side tabs 35 facing the front wall 23, likewise with residual connections 41.

The overlapping strip 37 extending along the side tab 35 can be severed by means of the connecting cut 42 extending in an appropriate way. However, in the exemplary embodiments illustrated, the connecting cut 42 in each case terminates before reaching the respective overlapping strip 37, so that the latter is continuous. Consequently, when the pack or inner wrapping 20 is opened by pulling off or tearing off the opening flap 29, not only are the residual connections 41 severed, but also the overlapping strip 37 in a region adjacent to the connecting cut 42.

Figure 9:
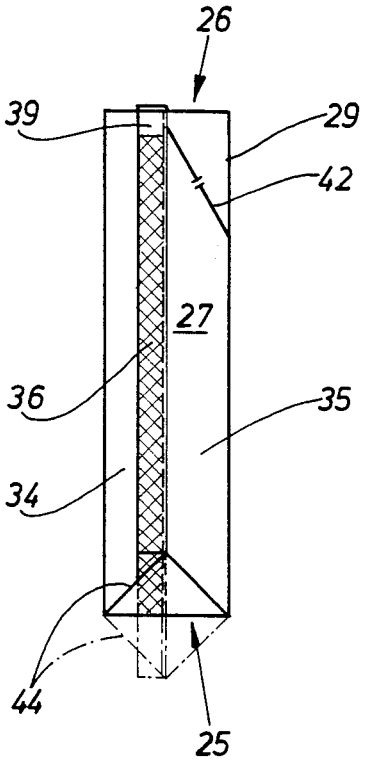
FIG. 9 shows a side view of a further embodiment of an inner wrapping (cigarette block)
Figure 10:
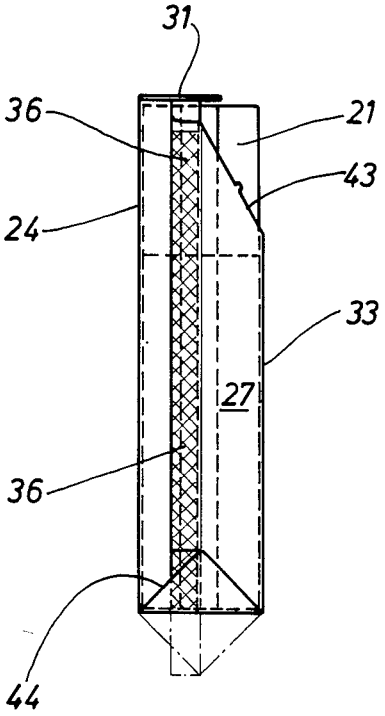
FIG. 10 shows the side view according to FIG. 9, with the opening flap pulled off.

In the exemplary embodiment of FIGS. 9 and 10, the portion 39 where the overlapping strips 37, 38 are not connected to one another in a sealed manner, in particular by means of adhesive bonding, is reduced because the connecting cuts 42 in the region of the side walls 27, 28 or in the region of the side tabs 35 starts from the end of the transverse punching 40 and extends obliquely upwards in the direction of the end wall 26 (FIG. 9). Here, the connecting cut 42 terminates at a short distance below the end wall 26. A sloping edge 43 is correspondingly formed in the region of the side tab 35 when the opening flap 29 is pulled off.

The overlapping strips 37 and 38 of the side tabs 34, 35 are connected continuously to one another in a sealed manner over their entire length in the region of the bonding strip 36. Connecting means which come under consideration are suitable adhesives known in the packaging industry, which are coated in strip form onto the overlapping strips 37, 38. Instead of this, a hot-melt strip is also suitable as a connecting and sealing-off means.

Figure 14:
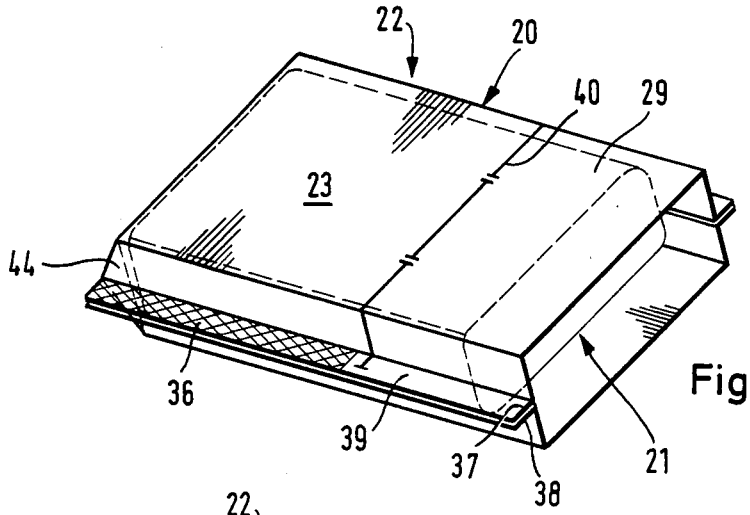
Figure 15:
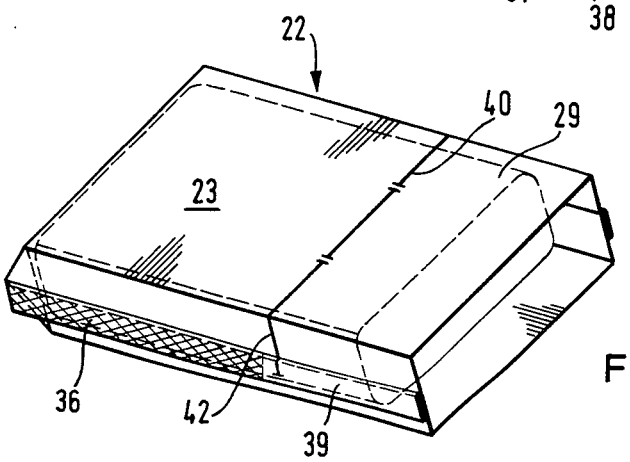
Figure 16:
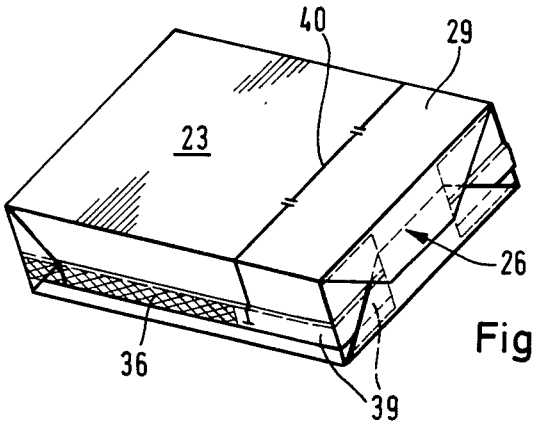

In the present case, the side tabs 34, 35 are folded in a special way, in particular so that the overlapping strips 37, 38 rest with their inner faces against one another and are bonded to one another, that is to say by means of the paper sides where conventional tin foil is concerned. Thus, in an intermediate folding position (FIG. 14), the overlapping strips 37, 38 form a fin which extends in the longitudinal centre plane of the side walls 27, 28 and which is directed transversely relative to these. The overlapping strips 37, 38, by being pressed together, are connected to one another firmly and in a sealed manner in the region of the bonding strip. Because of the special form of this lateral fold, the bonding strip extends into the region of a triangular gusset 44 obtained as a transition between the bottom wall 25 and the side walls 27, 28. In an intermediate position, this is first directed downwards beyond the bottom wall 25 in an extension of the side walls 27, 28 (indicated by dash lines in FIG. 4 or FIGS. 14 and 15). The bonding strip 36 formed by pressing together the over-lapping strips 37, 38 is then folded round through 90° against the side walls 27, 28. After that, the triangular gusset 44 is folded round through 180°, in particular likewise upwards and against the side walls 27, 28.

As shown, the bonding strip 36 is folded round in the direction of the rear wall 24, so that the overlapping strips 37 assigned to the side tab 35 of the front wall 23 are located on the outside. This makes it easier to pull off the opening flap 29 when the inner wrapping 20 is opened. The overlapping strip 37 is easily pulled off together with the opening flap 29 because it and the residual connections 41 are severed. The arrangement in the region of the end wall 26 is also such that the part of the overlapping strip 37 connected to the opening flap 29 is located at the top and can be pulled off together with the longitudinal end tab 30 attached to the opening flap 29. Together with the opening flap 29, not only the longitudinal end tab 30, but also the half of the lateral end tabs 32 and 33 which is connected to the latter is pulled off, that is to say removed from the inner wrapping As is evident, for example, from FIGS. 5, 6 and 10, approximately half the cross-section of the cigarette group 21 is thereby exposed in the region of the end wall 26 for the extraction of cigarettes. In the embodiment according to FIGS. 9 and 10, there is also free access to a front layer of cigarettes.

Figure 11:
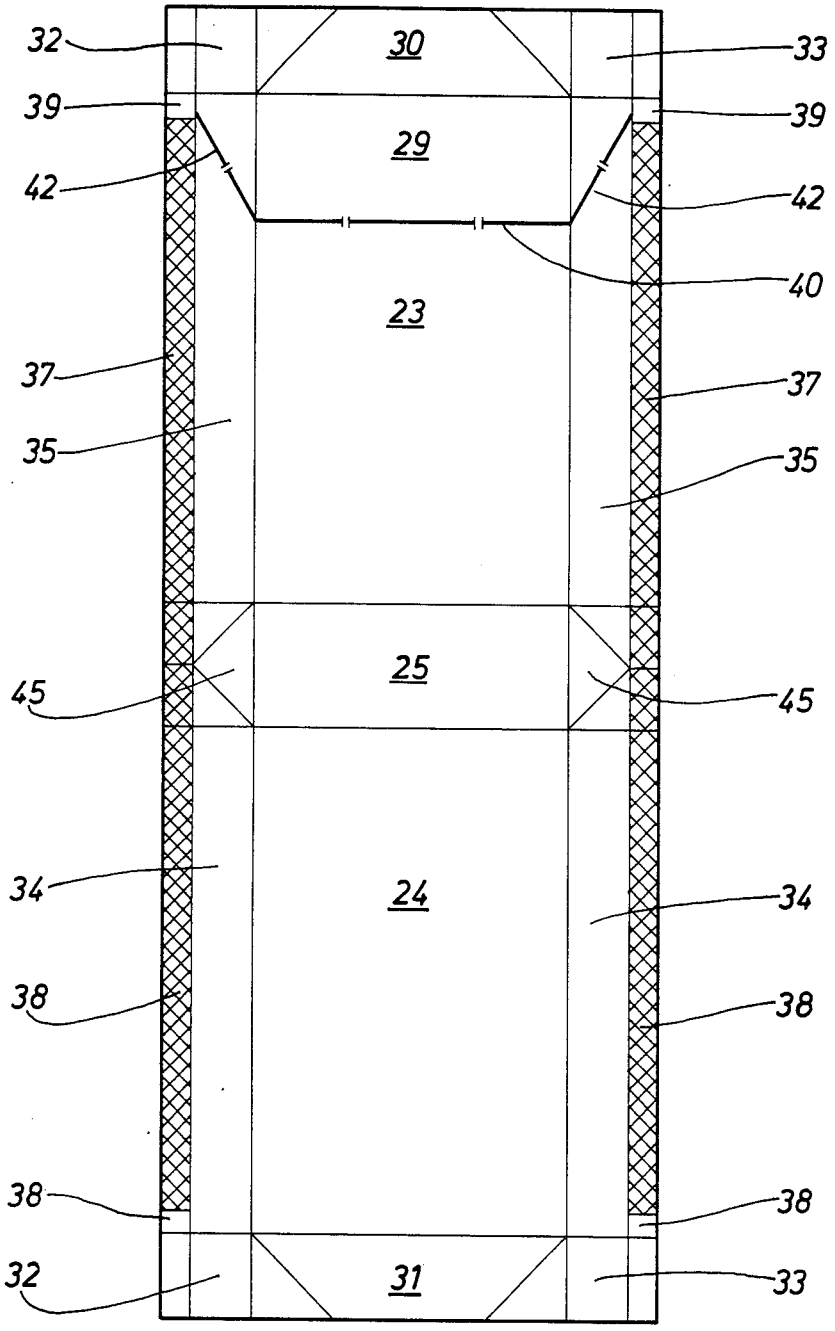
FIG. 11 shows a spread-out blank for an inner wrapping according to FIGS. 9 and 10, FIGS. 12 to 16 show various stages in the production of an inner wrapping according to FIGS. 1 to 7.

The inner wrapping 20 is formed from one-piece continuous blanks, such as are shown in FIG. 7 for the exemplary embodiment according to FIGS. 1 to 6 and in FIG. 11 for the exemplary embodiment according to FIGS. 9 and 10. The blank parts forming the (front) longitudinal end tab 30, the front wall 23 with the opening flap 29 as part of this, the bottom wall 25, the rear wall 24 and the longitudinal end tab 31 are marked in succession by folding lines. Laterally, the side tabs 35 adjoin the front wall 23 and the side tabs 34 adjoin the rear wall 24. Parts of the lateral end tabs 32, 33 are continuations of the side tabs 34, 35 in the region of the longitudinal end tabs 30 and 31.

Figure 8:
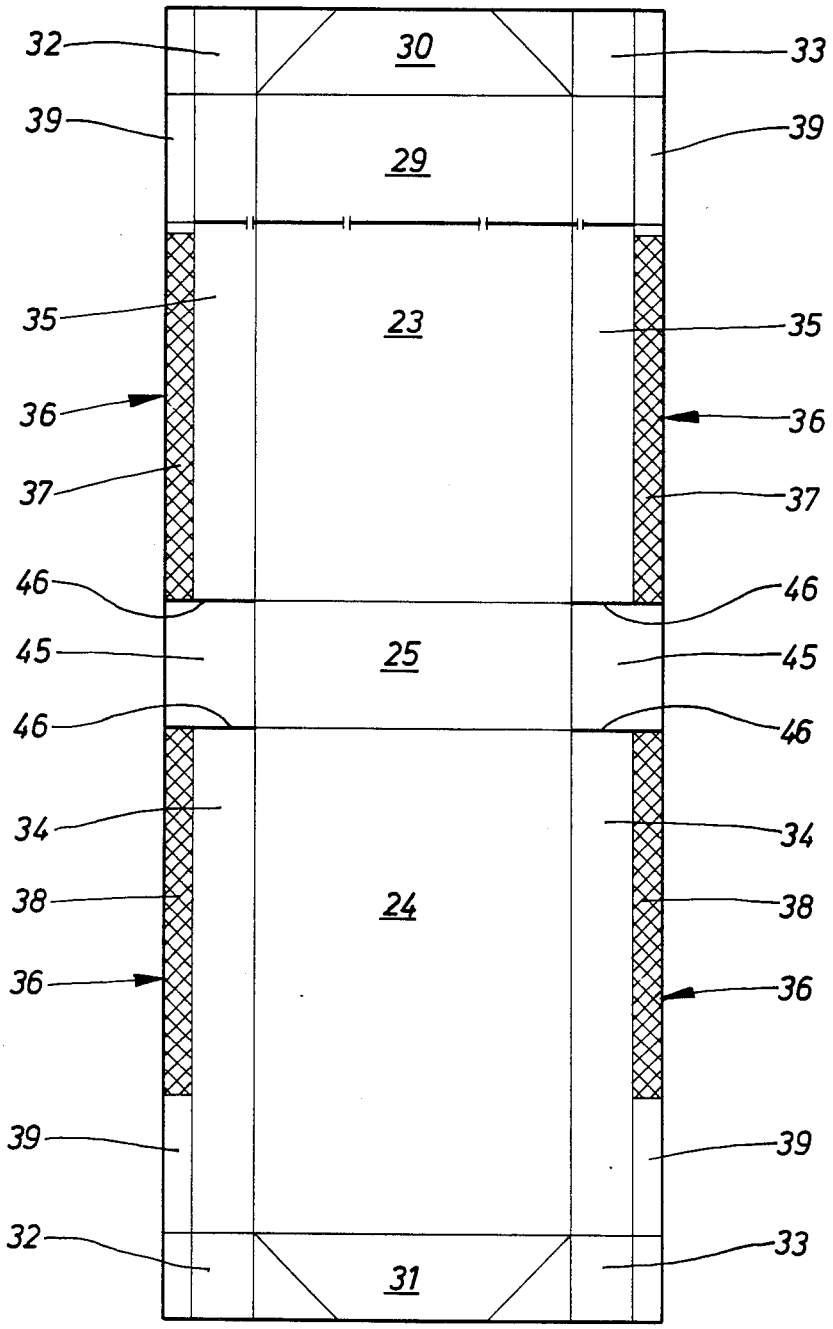
FIG. 8 shows a spread-out blank for a modified design of an inner wrapping according to FIGS. 1 to 6.

Adjoining the bottom wall 25 laterally are bottom corner tabs 45 which, in the exemplary embodiment of FIGS. 1 to 7, form the triangular gussets 44 as a result of appropriate folding. In the exemplary embodiment of FIG. 8, the bottom corner tabs 45 are divided off from the side tabs 34, 35 by means of severing cuts 46. In this embodiment, the bottom corner tabs 45 are folded upwards against the side regions of the cigarette group 21.

Figure 12:
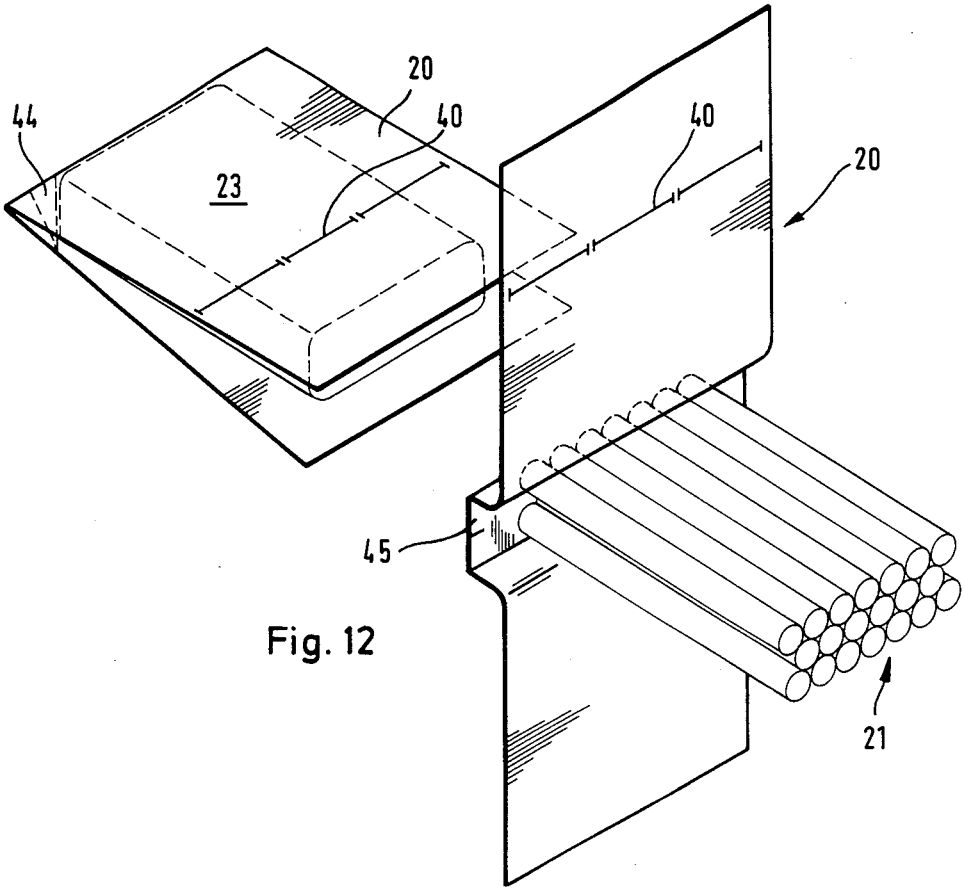
Figure 13:
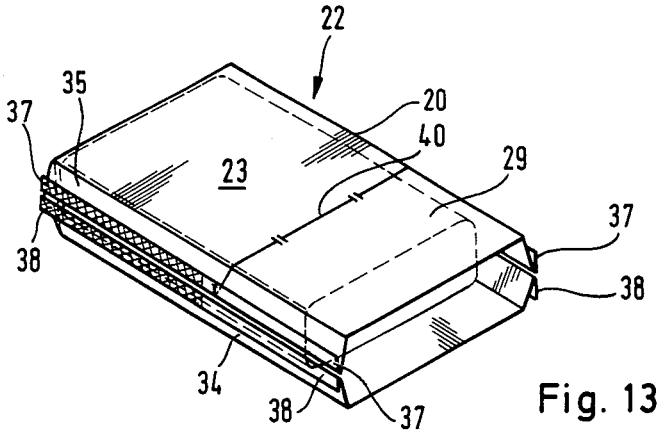

When the inner wrapping 20 is produced from one of the blanks described, according to FIG. 12 the cigarette group 21 is conveyed through the plane of a blank of an inner wrapping 20, provided transversely relative to the direction of movement, and at the same time takes up the latter, so that it is wrapped round the cigarette group 21 in the form of a U, starting from the bottom wall 25. Then, in an intermediate folding position according to FIG. 13, the overlapping strips 37, 38 are folded in opposite directions, that is to say away from one another, so that the inner faces are turned outwards. By means of a glue-coating tool (not shown), the inner faces of the overlapping strips 37, 38 can now be provided with glue along the bonding strip 36 to be formed, that is to say leaving out the portion 39. The covering strips 37, 38 are now pressed together over the entire length of the inner wrapping 20, to form the bonding strip 36. This is then folded round against the side walls 27, 28, as described. The inner wrapping 20 is completed in the usual way by folding round the triangular gussets 44 and by folding the end wall 26.

The exemplary embodiments illustrated can also be modified, to the effect that the bonding strip 36 extends over the full length of the inner wrapping 20, if appropriate including the region of the lateral end tabs 32, 33. In this case, the opening flap 29 is marked by a punching or perforation extending along the edge of the bonding strip 36, so that it can be detached here from the bonding strip 36 remaining on the inner wrapping 20.

We claim:

1. Cuboid pack for cigarettes, with an outer wrapping consisting of thin cardboard, and having an inner wrapping surrounding a cigarette group, comprising:

(a) an inner wrapping (20) made out of a tinfoil blank;

(b) the inner wrapping (20) being provided with a pull-off opening flap (29) which extends in an upper region of a longitudinal front wall (23), in a front sub-region of an upper end wall (26) and in an upper, front sub-region of narrow side walls (27, 28) of the inner wrapping (20);

(c) in the narrow side walls (27, 28) of the inner wrapping (20), each side wall comprising side tabs (34, 35) bonded to one another along overlapping strips (37, 38) of the side tabs only up to an unbonded portion (39) adjacent to the opening flap, to form a sealed bonding strip (36) preventing aroma and moisture losses;

(d) the overlapping strips (37, 38) being bonded to one another in a fin-fold along their inner faces turned towards one another;

(e) in the region of the opening flap (29), the overlapping strips (37, 38) lying with their inner faces against each other, in the unbonded portion (39);

(f) each bonding strip (36), together with its adjacent unbonded portion (39), being folded around until it comes up against a corresponding one of the side walls (27, 28); and (g) a transverse connecting cut (42) in each front side tab adjoining a transverse punching (40) in the front wall (23), each connecting cut delimiting the opening flap (29) in each of the front side tabs (35) in front of the overlapping strips (37, 38), so that the overlapping strips extend uninterrupted over the longitudinal length of the inner wrapping (20) below said opening flap (29).

2. Cuboid pack for cigarettes, with an outer wrapping consisting of thin cardboard, and having an inner wrapping surrounding a cigarette group, comprising:

(a) an inner wrapping (20) made out of a tinfoil blank;

(b) the inner wrapping (20) being provided with a pull-off opening flap (29) which extends in an upper region of a longitudinal front wall (23), in a front sub-region of an upper end wall (26) and in an upper, front sub-region of narrow side walls (27, 28) of the inner wrapping (20);

(c) in the narrow side walls (27, 28) of the inner wrapping (20), each side wall comprising side tabs (34, 35) bonded to one another along overlapping strips (37, 38) of the side tabs including a region above the lowermost point of the opening flap (29), to form a sealed bonding strip (36) preventing aroma and moisture losses;

(d) the overlapping strips (37, 38) being bonded to one another in a fin-fold along their inner faces turned towards one another;

(e) each bonding strip (36) being folded around until it comes up against a corresponding one of the side walls (27, 28); and a connecting cut (42) in each front side tab adjoining a transverse punching (40) in the front wall (23), each connecting cut delimiting the opening flap (29) in each of the front side tabs (35) in front of the overlapping strips (37, 38), so that the overlapping strips extend uninterrupted over the longitudinal length of the inner wrapping (20) below said opening flap (29), wherein each connecting cut (42) is directed obliquely upwards from the transverse punching in the direction of the upper end wall (26).

* * * * *